United States Patent [19]

Barker et al.

[11] 4,148,437

[45] Apr. 10, 1979

[54] COMBUSTOR

[75] Inventors: Michael H. Barker, Ockley; Alan G. Roberts, Dorking, both of England

[73] Assignee: The British Petroleum Company Limited, London, England

[21] Appl. No.: 862,586

[22] Filed: Dec. 20, 1977

[51] Int. Cl.[2] ..... F23D 19/00

[52] U.S. Cl. ..... 239/424; 239/419.3; 431/170

[58] Field of Search ..... 431/7, 170; 432/58; 34/57 A; 239/418, 419.3, 422, 424, 427.5, 428, 432, 433

[56] References Cited

U.S. PATENT DOCUMENTS

| | | | |
|---|---|---|---|
| 3,881,857 | 5/1975 | Hoy et al. | 37/57 A X |
| 3,914,089 | 10/1975 | Desty et al. | 431/170 X |
| 3,958,916 | 5/1976 | Barker et al. | 431/170 |

FOREIGN PATENT DOCUMENTS

| | | | |
|---|---|---|---|
| 2358375 | 5/1975 | Fed. Rep. of Germany | 239/424 |

*Primary Examiner*—Robert W. Saifer

*Attorney, Agent, or Firm*—Morgan, Finnegan, Pine, Foley & Lee

[57] ABSTRACT

A nozzle for injecting fuel oil into a fluidized bed combustor has a pair of co-axial tubes, each of which is connected to an air supply and each having internal outlets. The inner co-axial tube projects beyond and has its outlet beyond the outer co-axial tube outlet. The oil is supplied from a further tube within the inner co-axial tube and having its outlet near the outlet of the inner tube. Air passing down the inner tube entrains the oil emerging from the oil supply tube and the oil/air mixture then passes into and is reacted in the fluidized bed.

8 Claims, 1 Drawing Figure

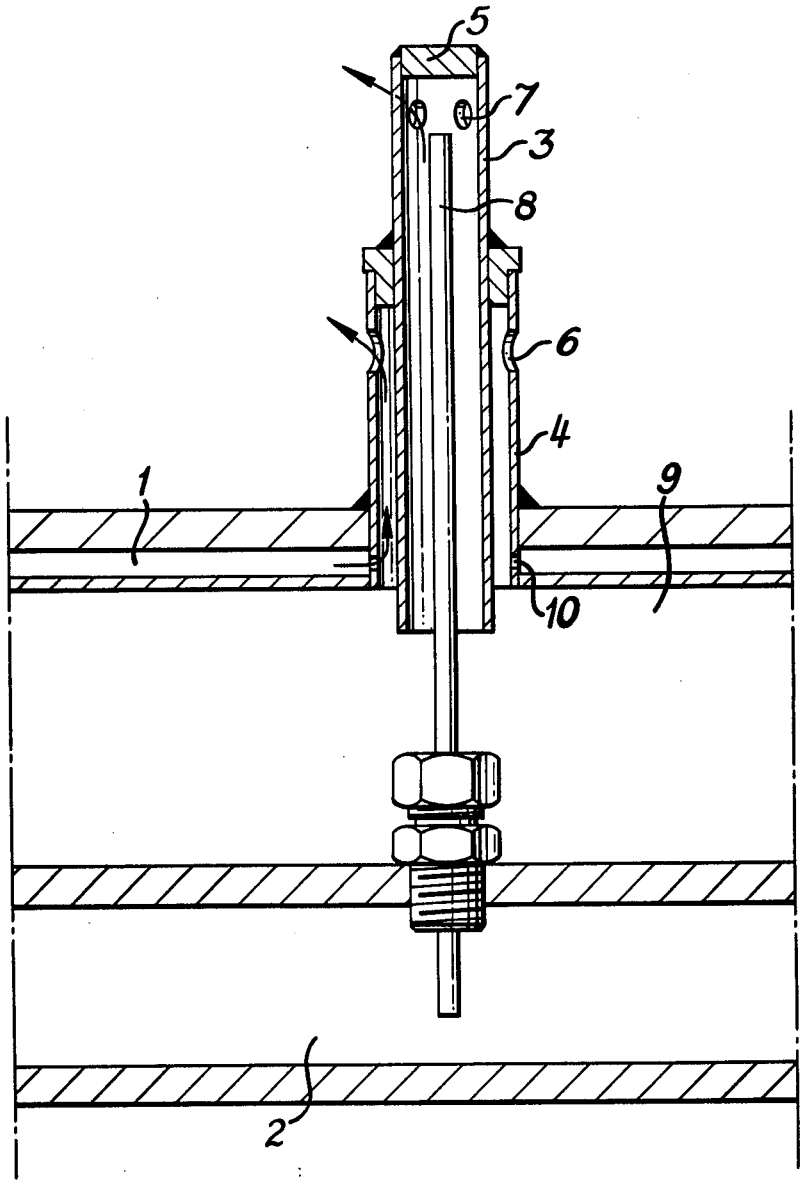
5
7
3
8
6
4
1
9
10
2

COMBUSTOR

This invention relates to a nozzle injection unit suitable for supplying liquid fuel to a fluidised bed combustor.

A fluidised bed combustor is operated by flowing air through a bed of inert particulate material to maintain the bed in a fluidised state and injecting fuel into the bed so that combustion occurs. The fuel, which may be solid, liquid or gaseous, or a mixture, burns within the bed which is maintained at a temperature which may typically be in the range 700°–1800° C. and from which a controlled extraction of heat may be made.

Fluidised bed combustors are capable of very high heat outputs per unit volume capacity and high rates of heat transfer can be transmitted to cooling surfaces immersed in the bed. The use of the term "fluidised bed combustor or furnace" is intended to cover the use of a fluidised bed as both a combustor and as a gasifier whereby partial reaction of a fuel and an oxygen containing gas produces a combustible gas which may be stored or burned at a point remote from the fluidised bed.

Difficulties, however, have sometimes been encountered in supplying liquid fuels, such as fuel oil to fluidised bed furnaces, since there is a tendency for supply nozzles to become blocked, and the combustion characteristics can be very sensitive to fuel distribution.

Our U.S. Pat. No. 3,958,916 describes a distributor plate comprising a chamber having a fuel inlet and an air tube passing through the chamber, the interior of the air tube being in communication with the chamber, one end of the air tube terminating in a head having outlets adapted to supply a combustible mixture including fuel and air to a fluidised bed furnace, there being a surrounding tube around the air tube, which surrounding tube has an air inlet and air outlet, the air outlet being adapted to supply air to a region of the fluidised bed beneath the head supplying the combustible mixture to the fluidised bed.

The present invention uses a direct oil injection technique into the air tubes in contrast to the climbing oil film technique used in the aforementioned patent.

In certain applications, the climbing oil film technique is not entirely suitable as an air supply at a significantly higher pressure is required to carry a liquid such as oil along the air tubes than is required for mere fluidisation of the bed alone. Thus separate air supplies may be needed for each purpose. The present invention is directed towards a means of supply of fuel oil to the bed which uses the same air supply as for bed fluidisation thereby potentially simplifying the equipment.

According to the invention there is provided a nozzle injection unit suitable for use in a fluidised bed combustor, the nozzle injection unit comprising first and second co-axial tubes, the first co-axial tube being partly surrounded by the second co-axial tube, each having an inlet for an air supply and an outlet which comprises a lateral passageway through the tube wall the first co-axial tube projecting beyond and having its outlet beyond the outlet of the second co-axial tube, characterised in that there is a third tube capable of supplying fuel oil which has its outlet within the first co-axial tube and near to the outlet of the first co-axial tube.

The air supply is pressurised so as to fluidise the furnace bed.

The second co-axial tube is also preferably connected to a supply of fuel gas, e.g. propane, so that prior to the fluidised bed furnace being used for, say, oil burning, it is started up by pre-heating the bed by combustion of the fuel gas and air.

The oil supply or third tube preferably comprises a vertical tube connected to an oil chamber (integral with a distributor plate or externally supplied) and co-axial with the other tubes, the open upper end of the vertical tube being situated near to the outlet of the internal co-axial tube. The term "near" is intended to mean that the outlet of the third tube is situated not more than a distance of one diameter of the first co-axial tube above the outlet of the first co-axial tube and not more than a distance of twice the diameter of the first co-axial tube below the outlet of the first co-axial tube.

The invention also comprises a distributor plate for a fluid bed which distributor plate preferably comprises a plurality of nozzle injection units.

The density of the nozzle injection units may be varied to suit each particular requirement and preferably a density of nozzle injection units of 0.25 to 1 per square foot is used. (Additional air for fluidising and combustion purposes may be supplied by open ended tubes passing through the distributor plate).

The lateral outlets of the co-axial tubes form passageways through the tube walls, the direction of the passageways being preferably substantially perpendicular to the tube wall. Preferably the cross-sectional area of the outlets of the first co-axial tube is less than 1% of the total area of the plate.

In one embodiment of the invention, an oil chamber is formed beneath the nozzle injection units by means of a pair of substantially horizontal plates. Preferably the oil chamber has air tubes, most preferably vertical, passing through it. These air tubes preferably have a cross-sectional area of about 1 to 5% of the total area of the plate.

The air supply to the first and second co-axial tubes may be common or separate, but preferably the former.

The proportion of air entering the first co-axial tube depends on the bed material being fluidised but it is typically 10 to 50% of the total.

The inner air tube and oil tube may be designed so that they are removable, e.g. for cleaning and inspection, while the fluidised bed combustor is in operation by a method similar to that described in pending U.S. patent application Ser. No. 830,832, filed Sept. 6, 1977, assigned to The British Petroleum Company Limited.

The bed itself comprises mineral particles of a size range and bulk density appropriate to the velocity of the fluidising gas.

The invention will now be described with reference to the accompanying drawing.

The drawing shows a partial vertical cross-section through a distributor plate according to the invention, the section showing a single oil injector unit for oil, air (and fuel gas) distribution to a fluidised bed.

The fluidised bed furnace may comprise a plenum chamber, a distributor plate and a fluidised bed of sand. The bed is contained by a refractory-lined or water cooled vessel.

The distributor plate comprises a fuel gas chamber 1, an oil chamber 2 and a vertical assembly of two concentric tubes 3, 4. The inner tube 3 of the two tubes terminates in a head 5 adapted to supply a combustible mixture of oil and air to the fluidised bed through outlets 7. The shorter outer tube 4 has outlets 6 adapted to supply combustion air to the fluidised bed. The air is supplied to the tubes 3, 4 through the oil chamber 2 and air chamber 9.

The passage of air through outlets 6 fluidises the bed below the oil injection point to discourage stagnation of the bed, i.e. to obtain as effective a fluidisation of the bed as possible.

During use of the furnace, the fluidised bed is preheated by means of propane supplied from the fuel gas chamber 1 through holes 10 and along tube 4. After suitable bed operating conditions have been reached, the propane supply is gradually reduced and the oil feed supply switched in.

The central tube 8 supplies oil under pressure from chamber 2 to the fluidised bed. The oil is sheared from the outlet of tube 8 by air passing along the inner tube 3 and the combustible mixture of oil and air passes via head 5 and outlets 7 into the fluidised bed. The fuel oil is supplied to the central tube 8 by means of a pump (not shown). The distribution of oil to each tube 8 is equalised by arranging for the pressure drops along each tube to be in the range 5 to 10 p.s.i.

A fluidised bed of 6 inches diameter was filled with about 30 lbs. of sand of −10 +16 BSS mesh size and bulk density of 80–100 lbs. per cubic foot. The distributor plate had a single nozzle injection unit, the central oil tube 8 being about ⅛ inch bore, and the internal diameter of tube 3 being 11/32 inches and having four outlet holes of 7/32 inches diameter. The outer tube 4 had eight outlet holes of 3/16 inch diameter. The oil was pre-heated to about 65° C. and at a freeboard gas oxygen content of less than 5% the oil flow was about 0.4 gallons/hour. The air flows through the tubes were of the order 200 to 500 cubic feet per hour.

We claim:

1. A nozzle injection unit comprising first and second co-axial tubes, the first co-axial tube being partly surrounded by the second co-axial tube, each having an inlet for an air supply and an outlet which comprises a lateral passageway through the tube wall, the first co-axial tube projecting beyond and having its outlet beyond the outlet of the second co-axial tube characterised in that there is a third tube capable of supplying fuel oil which has its outlet within the first co-axial tube and near to the outlet of the first co-axial tube.

2. A nozzle injection unit according to claim 1 in which the second co-axial tube also has an inlet for a fuel gas supply.

3. A nozzle injection unit according to claim 1 in which the lateral passageway is at right angles to the first co-axial tube wall.

4. A distributor plate having a nozzle injection unit according to claim 1 and a means for supply of pressurised gas.

5. A distributor plate according to claim 4 having an oil chamber formed beneath the nozzle injection unit from a pair of substantially horizontal plates.

6. A distributor plate according to claim 4 having a density of nozzle injection units of 0.25 to 1 per square foot.

7. A distributor plate according to claim 4 in which the cross-sectional area of the outlets of the first co-axial tube is less than 1% of the total plate area.

8. A distributor plate according to claim 4 having a plurality of tubes connected to an air supply only and having an outlet cross-sectional area of 1 to 5% of the total area of the plate.

* * * * *